United States Patent [19]

Clüsserath

[11] Patent Number: 5,016,684

[45] Date of Patent: May 21, 1991

[54] METHOD AND APPARATUS FOR DISPENSING CARBONATED LIQUIDS, ESPECIALLY BEVERAGES, INTO CONTAINERS UNDER COUNTER PRESSURE

[75] Inventor: Ludwig Clüsserath, Bad Kreuznach, Fed. Rep. of Germany

[73] Assignee: Seitz Enzinger Noll Maschinenbau Aktiengesellschaft, Mannheim, Fed. Rep. of Germany

[21] Appl. No.: 566,864

[22] Filed: Aug. 10, 1990

Related U.S. Application Data

[63] Continuation of Ser. No. 318,729, Mar. 3, 1989, abandoned.

[30] Foreign Application Priority Data

Mar. 4, 1988 [DE] Fed. Rep. of Germany ..... 3807046

[51] Int. Cl.[5] ..... B67C 3/08

[52] U.S. Cl. ..... 141/6; 141/39; 141/52

[58] Field of Search ..... 141/6, 39, 46, 47, 50–53, 141/57–59

[56] References Cited

U.S. PATENT DOCUMENTS

| | | | |
|---|---|---|---|
| 2,060,276 | 11/1936 | Bondurant | 141/6 |
| 2,953,169 | 9/1960 | Breeback | 141/6 |
| 3,478,785 | 11/1969 | Mallrich et al. | 141/52 X |
| 3,699,740 | 10/1972 | Knabe | 141/6 |
| 3,782,427 | 1/1974 | Zeimet et al. | 141/39 |
| 3,802,471 | 4/1974 | Wickenhauser | 141/39 |
| 3,877,358 | 4/1975 | Karr | 99/275 |
| 3,886,982 | 6/1975 | Uth et al. | 141/39 |
| 4,201,249 | 5/1980 | Borstelmann | 141/39 |
| 4,342,344 | 8/1982 | Ahlers | 141/39 |
| 4,381,808 | 5/1983 | Ahlers | 141/39 |
| 4,390,048 | 6/1983 | Zelder | 141/6 |
| 4,557,301 | 12/1985 | Jorss | 141/5 |
| 4,949,764 | 8/1990 | Clusserath | 141/6 |

FOREIGN PATENT DOCUMENTS

| | | | |
|---|---|---|---|
| 1008349 | 10/1965 | United Kingdom | 141/6 |

*Primary Examiner*—Henry J. Recla
*Assistant Examiner*—Casey Jacyna
*Attorney, Agent, or Firm*—Robert W. Becker & Associates

[57] ABSTRACT

Method and apparatus for dispensing carbonated liquids into a container under counterpressure. The introduction of liquid under a filling pressure into a container that is in a sealing position with a filling element is effected during a filling phase that follows pressurizing of the container. Return gas displaced by incoming liquid is at least briefly withdrawn from the container via a return gas passage of the filling element. After termination of the filling phase, with the container still in a sealing position with the filling element, first a pre-relief of pressure in the container to a pre-relief pressure is effected, and subsequently a relief to atmospheric pressure is effected. The pre-relief pressure is regulated in such a way to a pressure that is between atmospheric pressure and the saturation pressure of the liquid, that during the pre-relief phase it is still just possible for released carbon dioxide to rise in the dispensed liquid without there occurring during relief to atmospheric pressure an undesired escape of liquid from a filled container as a result of foaming of the liquid.

24 Claims, 5 Drawing Sheets

METHOD AND APPARATUS FOR DISPENSING CARBONATED LIQUIDS, ESPECIALLY BEVERAGES, INTO CONTAINERS UNDER COUNTER PRESSURE

This application is a continuation of application Ser. No. 318,729 filed Mar. 3, 1989 now abandoned.

BACKGROUND OF THE INVENTION

1. The present invention relates to a method of dispensing a carbonated liquid, especially a beverage, into a container, such as a bottle, under counterpressure, whereby the introduction of the liquid, which is under a filling pressure, into the container, which is in a sealing position with a filling element, is effected during a filling phase that follows pressurizing of the container, whereby return gas displaced by incoming liquid is withdrawn from the container, at least for a while, via a return gas passage of the filling element, and whereby after termination of the filling phase with the container still in a sealing position with the filling element, first a pre-relief of pressure in the container to a pre-relief pressure is effected in a pre-relief phase, and subsequently a relief of pressure in the container to atmospheric pressure is effected. The present invention also relates to an apparatus for carrying out this method, with the apparatus including: a liquid chamber for the liquid that is to be dispensed; at least one filling element, with which a respective container that is to be filled is brought into a sealing position at least during pressurizing of the container, a filling phase, and first a prerelief of the pressure of the filled container to a pre-relief pressure, and subsequently a relief of the pressure of the filled container to atmospheric pressure; a filling channel that is provided on the filling element and that is adapted to communicate with the liquid chamber via a controlled liquid flow valve; a return gas passage formed on the filling element for return gas that is displaced from the container during the filling phase and/or that flows off during relief of the container; and a chamber that includes outlet means to the atmosphere and that communicates with the return gas passage at least during the pre-relief phase, which follows the filling phase.

2. Description of the Prior Art

When carbonated liquids, especially beverages, are dispensed under counterpressure into containers, such as bottles, it is necessary after termination of the liquid introduction, i.e. the filling phase, to relieve the pressure of the container to atmospheric pressure. With liquids, such as champagne or soft drinks, that already due to their relatively high $CO_2$ content have no ideal filling properties, and in particular especially when these liquids are to be dispensed at relatively high temperatures for economical reasons, it is necessary to carefully relieve the pressure in such a way that foaming up or over of the dispensed liquid is avoided. For this purpose, it is known to undertake the relief to atmospheric pressure in stages such that a pre-relief phase precedes the actual relief of pressure to atmospheric pressure.

With one known method of this type (German Auslegeschrift 11 27 241 Quest dated Apr. 5, 1962), at the conclusion of the filling phase, the gas volume present in the filled container is briefly released to the atmosphere, and in particular by briefly opening a relief valve provided on the filling element via a cam of the filling machine, and immediately thereafter again closing this valve, so that as a result of the thereby occurring relief of the gas volume of the container to a lower pressure value, the carbon dioxide that is not fixedly contained in the dispensed liquid can escape and the dispensed liquid can become calm prior to the final relief to atmospheric pressure and the withdrawal of the container from the pertaining filling element. However, one of the drawbacks of this heretofore known method is that a pre-relief to a defined and also always constant pre-relief pressure cannot be achieved, which is a necessary precondition for an economical bottling at maximum capacity or efficiency. Since with the known method the brief opening of the relief valve of the filling element is effected by a cam, it is in principle also not possible to adapt the pre-relief to liquids having different filling characteristics.

Also known is a method of dispensing carbonated liquids under counterpressure into containers with the aid of a single-chamber counterpressure ,filler (German Offenlegungsschrift 36 22 807 Schadel et al dated Jan. 21, 1988). With this method the filling phase is terminated, by closing the liquid flow valve of the pertaining filling element, when a liquid level is reached in the container where the lower end of a return gas tube extends into the dispensed liquid. After conclusion of the filling phase, i.e. after closing of the liquid flow valve, the return gas tube is connected with an annular chamber that has a pressure that is less than the pressure that exists in the liquid chamber, so that the liquid that is above the lower end of the return gas tube is conveyed off out of the bottle, through this return gas tube, and into the annular chamber. The object of this measure is to correct the filling level obtained at the conclusion of the filling phase to a predetermined desired height; this measure is not a pre-relief of the respective container.

It is therefore an object of the present invention to provide a method and apparatus with which in an economical manner even liquids having very different filling characteristics can be optimally dispensed, and in particular via an optimum adaptation of the pre-relief pressure to the filling characteristics of the respective liquid that is to be dispensed in such a way that it is possible to work with as low a pre-relief pressure as possible, yet during the relief of the pressure to atmospheric pressure, a foaming of the dispensed liquid as well as an escape of this liquid out of the container can be avoided via channels of the filling element.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
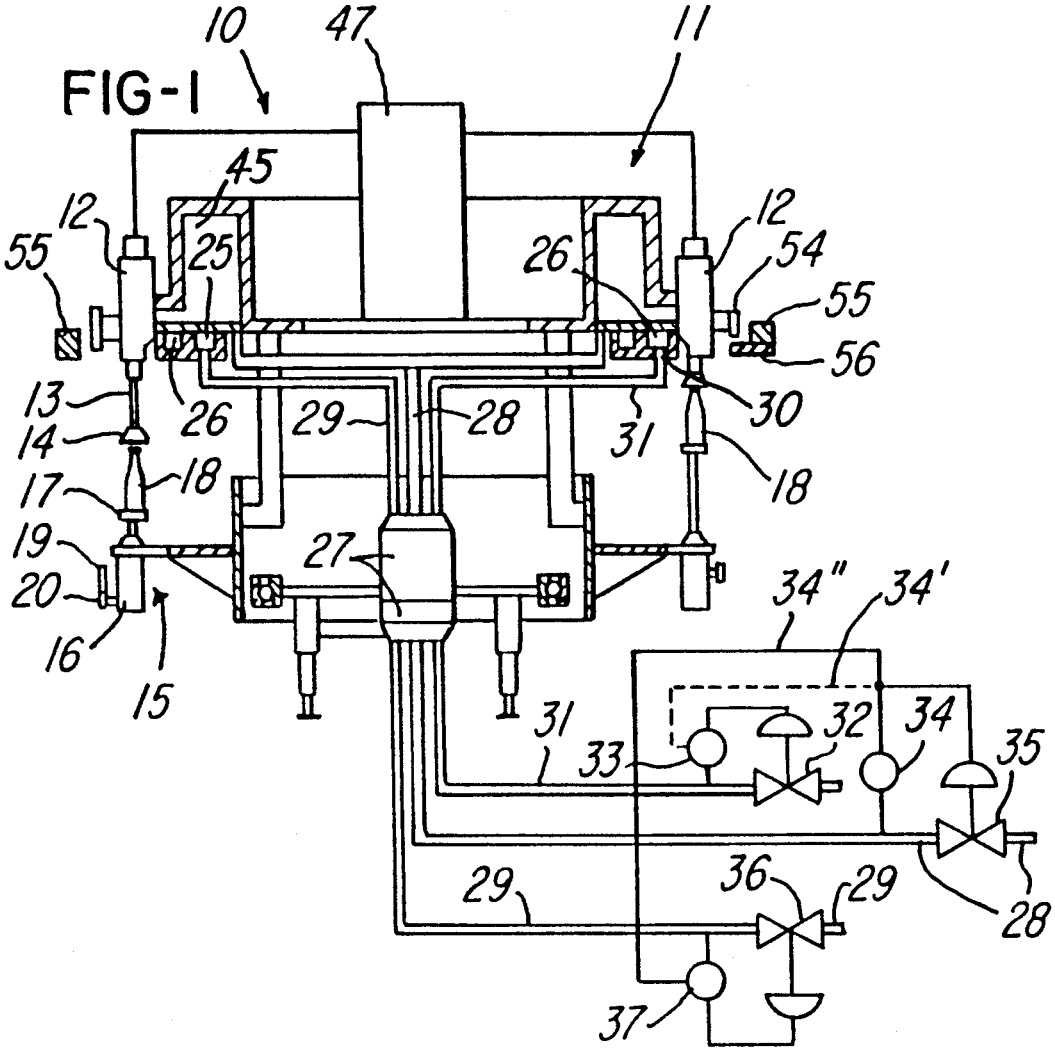
FIG. 1 is a diagrammatic view of one exemplary embodiment of an inventive multi-chamber counterpressure filling machine having controlled filling elements.

The method of the present invention is characterized primarily in that the pre-relief pressure is regulated in such a way to a pressure that is between atmospheric pressure and the saturation pressure of the liquid, that during the pre-relief phase it is still just possible for released $CO_2$ to rise in the dispensed liquid without there occurring during relief to atmospheric pressure an undesired escape of liquid from a filled container as a result of violent bubbling or foaming of the liquid.

The apparatus of the present invention is characterized primarily by a regulating valve that is connected to the outlet means of the chamber, with the regulating valve being adapted to be opened when the pressure in the chamber exceeds the pre-relief pressure, which is to be regulated as described above. The method of the present invention is suit able for filling containers with single or multi-chamber counterpressure filling machines, and, merely by setting the pressure that is regulated in the chamber, enables an optimum adaptation of the pre-relief pressure to the liquids that are to be dispensed with the machine and that often have very different filling characteristics. This above all also assures that with each pre-relief the same pre-relief pressure is again effective; in other words, with each prerelief the same conditions are always set. With the method of the present invention, even liquids such as champagne or soft drinks that have very problematic filling characteristics can be dispensed at relatively high temperatures and at high dispensing rates in a clean manner, i.e. without foaming or escape from the container or bottle, for example even champagne having a $CO_2$ content of about 9.5 g $CO_2$/liter and a filling temperature of 15° C.

When champagne having a $CO_2$ saturation pressure of approximately 3 0 bar is dispensed, a filling pressure of 6.5 bar is used, whereby the pre-relief pressure during a pre-relief time of approximately 1.5 seconds can be reduced to 0.8 bar without a foaming or escape of champagne in or out of the respective bottle occurring, and in particular despite the relatively high filling temperature of 15° C.

Within the context of the present invention, the saturation pressure or $CO_2$ saturation pressure is that pressure at which there is still no rising of carbon dioxide bubbles in a liquid at a specific $CO_2$ content and a specific temperature.

If with the inventive method the return gas that is displaced during the filling of the container is withdrawn at a pressure gradient into the chamber via a connection that is provided with a throttle mechanism, the pressure conditions, to the extent that the filling characteristics of the liquid that is to be dispensed permit this, are preferably regulated in such a way that the prerelief pressure that is set or regulated in the chamber continues to lie between the atmospheric pressure and the saturation pressure, preferably below the saturation pressure, yet at the same time is also between the filling pressure and a critical pressure of the throttle mechanism. In this way it is then also possible, without altering the throttle mechanism, to also optimize the filling rate with respect to the filling characteristics of the liquid that is to be dispensed.

In this connection, the critical pressure is that pressure in the chamber after which the volume stream of return gas that flows through the throttle mechanism during the filling phase has a pressure-dependent characteristic.

Further specific features of the present invention will be described in detail subsequently.

DESCRIPTION OF PREFERRED EMBODIMENTS

Referring now to the drawings in detail, FIG. 1 schematically illustrates a counterpressure filling machine, for example a rotating three-chamber counterpressure filling machine 10 for carbonated liquids, especially beverages. The filling machine 10 is provided with an annular liquid chamber 11, on the outer periphery of which a plurality of filling elements 12 are placed all the way around, with the filling elements being uniformly spaced from one another. Each filling element 12 is provided with an essentially vertical filling tube 13 and a vertically displaceable centering and sealing member 14. Associated with each filling element 12 is a raising and lowering mechanism 15 that includes a lifting cylinder 16 and a support plate 17 for each container 18, for example a bottle, that is to be filled. The raising and lowering function can be effected in such a way that the lifting cylinder 16 is constantly supplied with pressure medium in a raising direction, and by providing a cam 19 for the lifting cylinder in the vicinity of the nonillustrated bottle entry and bottle exit. Guide rollers 20 provided on the lifting cylinders 16 run on the cams 19 in order to lower each support plate 17 on which a filled container 18 is disposed prior to exit or discharge thereof, and to allow each support plate 17 in this lowered state to receive at the entry a container 18 that is to be filled and that is then raised by the support plate 17 to the respective filling element 12.

An annular distribution chamber 25 for pressurizing gas, as well as an annular return gas chamber 26 for return gas, are disposed at the base of the annular liquid chamber 11. Via a central distributor 27 of the filling machine 10, t he liquid chamber 11 is connected to a liquid line 28, and the annular distribution chamber 25 is connected to a pressurizing gas line 29. The outlet 30 of the return gas chamber 26, or a line 31 that forms an extension of the outlet 30 and similarly leads through the distributor 27, is connected with a regulating valve 32 which has associated therewith upstream thereof a pressure sensor 33, for example a pressure regulator, that is disposed in the extension line 31 or in the return gas chamber 26; the pressure in the return gas chamber 26 can be set or regulated at the pressure sensor 33. Provided in the liquid line 28 is a further pressure regulator or pressure sensor 34 that controls a further regulating valve 35 that is interposed upstream in the liquid line 28. In the embodiment illustrated in FIG. 1, the regulating valves 32 and 35 can be separately, i.e. independently, controlled by the pressure sensors 33 or 34 that are respectively associated therewith. In principle, however, it is also possible to provide a link between the pressure sensors such that the pressure set by the pressure sensor 33 in the return gas chamber 26 is a function of the pressure measured by the pressure sensor 34 in the liquid line 28 and hence is a function of the filling pressure that exists in the liquid chamber 11; this is indicated by the dashedline signal line 34' in FIG. 1. In this case, the control or regulating circuit that includes the pressure sensors 33 and 34 is, for example, then embodied in such a way that the pressure sensor 33, taking into consideration the pressure measured by the pressure sensor 34, opens the regulating valve 32 via a signal when the pressure differential between the filling pressure measured by the pressure sensor 34 and the return gas pressure measured in the return gas chamber 26 by the pressure sensor 33 exceeds a desired, preferably adjustable, differential pressure; in other words, for example at a predetermined filling pressure in the liquid chamber 11, the return gas pressure in the return gas chamber 26 is below the critical pressure of the subsequently to be described throttle mechanism of the filling elements 12. Hereby, with a regulated return gas pressure in the return gas chamber 26 that lies between the filling pressure and the critical pressure of the throttling mechanism, a control of the filling speed (the quantity of liquid flowing into the container 18 per unit of time) can be set to an optimum value by the return gas pressure in the return gas chamber 26.

The pressure in the annular distribution chamber 25 is regulated as a function of the filling pressure in the liquid chamber 11 or in the liquid line 28. For this purpose, interposed in the pressurizing gas line 29 is a regulating valve 36 with which is associated a pressure regulator or pressure sensor 37 that is disposed in the pressurizing gas line 29. For regulating reasons, the pressure sensor 37 is connected with the pressure sensor 34 via a control line 34'' in such a way that the pressure sensor 37, by actuation of the regulating valve 36 in the pressurizing gas line 29, sets such a pressurizing gas pressure that the pressure differential between the filling pressure in the liquid line 28 and the pressurizing gas pressure in the pressurizing gas line 29 corresponds to a predetermined, preferably preselectable, value, i.e. the pressurizing gas pressure in the pressurizing gas line 29 lies below the filling pressure in the liquid line 28 by this value.

Figure 2:
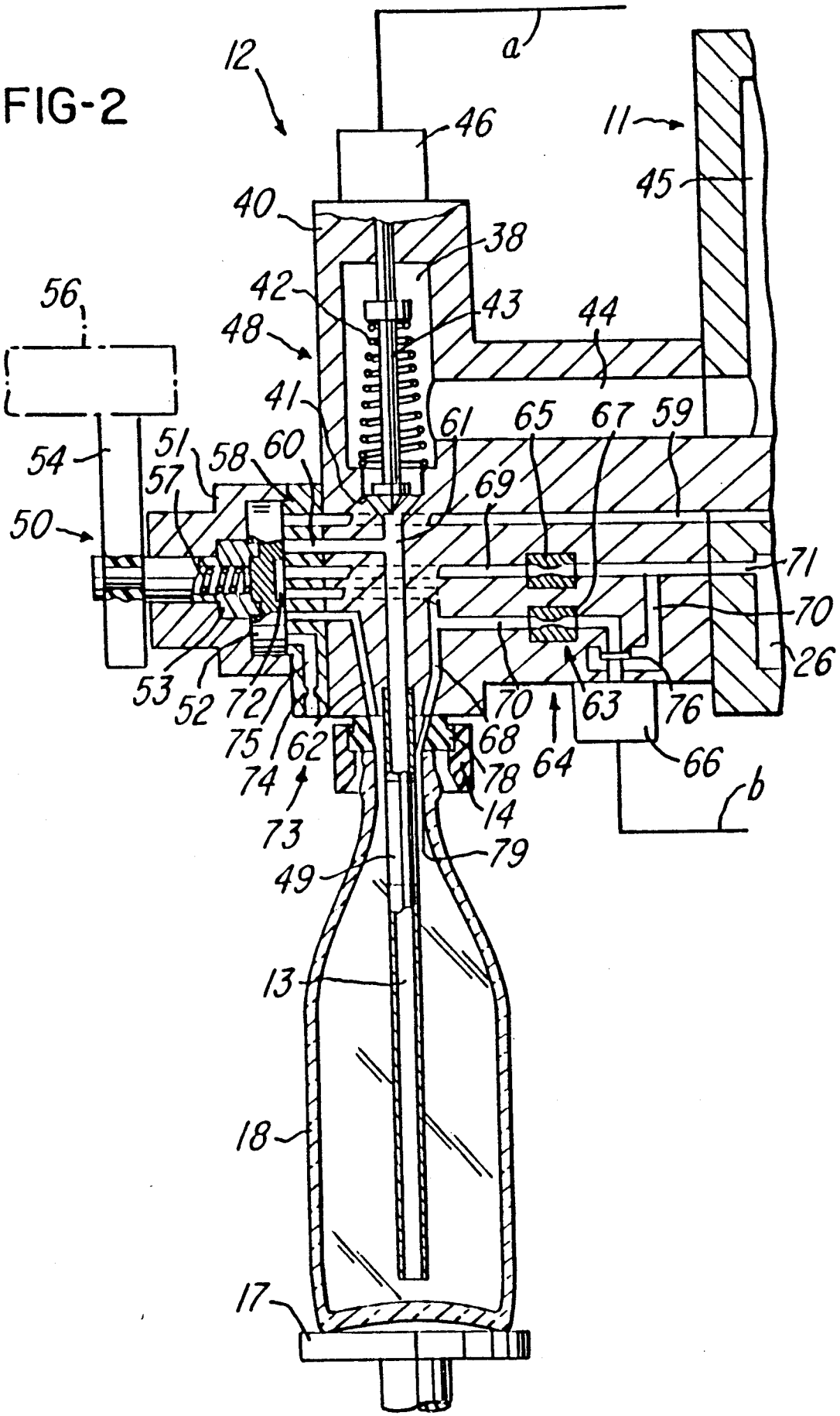
FIG. 2 is a diagrammatic view of a filling element of the counterpressure filling machine of FIG. 1.

The diagrammatic view of FIG. 2 shows one of the filling elements 12 that is disposed on the annular liquid chamber 27 in a filling position. The construction of the filling elements 12 is essentially known, with each filling element, in a valve chamber 38 of the filling element housing 40, being provided with a valve seat 41 and a valve body 43 that is raised from this valve seat via an opening spring 42. The valve chamber 38 is connected with the chamber 45 of the liquid chamber 11 via a liquid channel 44, and an electrical or electro-pneumatic actuating device 46 is dispose on the filling element housing 40 and is connected via a control line "a" to a central control mechanism 47 of the filling machine 10 (FIG. 1). In the activated state, the actuating device 46 presses the valve body 43, against the effect of the opening spring 42, onto the valve seat 41, thereby closing the liquid flow valve 48 o±the pertaining filling element 12, which liquid flow valve is formed by the valve seat 41 and the valve body 43.

The filling tube 13, which is provided in a known manner with an electrical switching element 49 (electrode arrangement) is inserted into the filling element housing 40 from below. The switching element 49 is connected via a nonillustrated signal line to the control mechanism 47. Disposed on the side of the filling element housing 40 is a pressurized gas valve arrangement 50 in the manner of a flat slide valve, in the housing 51 of which a flat valve member 52 is rotatably mounted via a carrier 53. On its free end that extends out of the housing 51, the carrier 53 is provided with an operating lever 54 that, in order to pivot the valve member 52 into the respectively required operating position, cooperates during rotation of the machine with control elements 56, for example cams, especially sequence switch cams, that are disposed at various distances and at different levels on a stationary control ring 55 of the filling machine 10. A spring 57 presses the valve member 52 against a base plate 58, in that surface of which that faces the valve member 52 opens the pressurized gas supply channel 59, which comes from the annular distribution chamber 25 and passes through the lower segment of the liquid chamber 11 and through the filling element housing 40. Also opening at that surface of the base plate 58 that faces the valve member 52 are an equalizing channel 60, which leads into an equalizing chamber 61 formed between the liquid flow valve 48 and the filling tube 13, as well as a pressurizing gas introduction channel 62 that can be connected with the pressurized gas supply channel 59 via a non-illustrated groove of the valve member 52, and that opens out at the bottom end of the filling element housing 40 or opens into an annular pressurized gas chamber that opens out at the bottom end.

From the bottom end of the filling element housing 40, a connection 64 that is provided with a throttle mechanism 63 leads through the filling element housing 40 to the return gas chamber 26. This connection on the one hand comprises a delivery channel section 68 that, from an inlet 79 disposed at the bottom end of the filling element housing 40, after an upwardly extending section, branches into a channel section 69 and a further channel section 70, and on the other hand comprises a withdrawal channel section 71 that is connected to the return gas chamber 26 and in which the channel section 69 and the further channel section 70 are again joined after extending for an adequate stretch. Provided in the channel section 69 is a Venturi-type tube 65 for effecting filling at a reduced filling speed; in the illustrated embodiment, this Venturi tube has an effective cross section of 0.64 mm. Provided in the further channel section 70 is a Venturi-type tube 67 that in the illustrated embodiment has an effective cross section of 0.81 mm and that cooperates with the Venturi tube 65 during filling at a high filling speed. The Venturi tubes 65 and 67 essentially form the throttle mechanism 63 of the connection 64. The channel section 69 can be closed off prior to the Venturi tube 65 in the direction of flow. For this purpose, the valve member 52 is provided with a control recess 72 via which, in a particular operating position of the valve member 52, those ends of the channel section 69 that open out at that surface of the base plate 58 that faces the valve member 52 can be connected for the purpose of withdrawing the return gas that is displaced during the filling process. Disposed downstream of the Venturi tube 67 in the direction of flow is an electrically or electro-pneumatically operable discharge valve 66 that is disposed in the further channel section 70. The discharge valve 66 is connected with the control mechanism 47 via a control line "b", and in the closed position interrupts the channel section 70 via a valve body 76.

Figure 3:
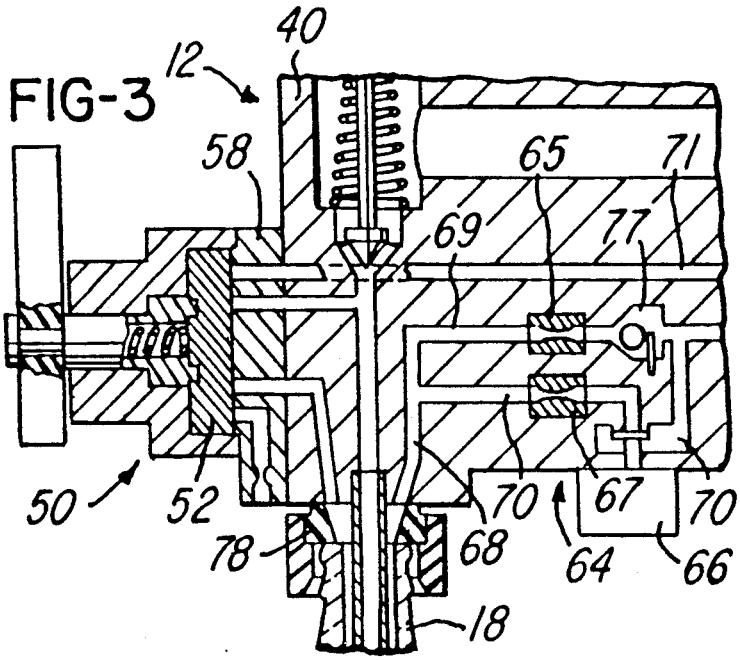
FIGS. 3 and 4 are views that show details of the blockable connection of the filling element via two embodiments that are modifications of the configuration of FIG. 2.

As shown in FIG. 3, it would also be possible to close off the channel section 69 via a check valve 77 that is disposed in the channel section 69 and that permits unobstructed withdrawal of the return gas, yet automatically prevents the return of return gas when a bottle breaks or during reduction of container pressure to atmospheric pressure. By the use of such a check valve 77, for example a ball retaining valve, the switching steps otherwise required to open or close the channel section 69 for the valve member 52, as well as the control recess 72 required in the valve member 52, are eliminated.

Provided in the pressurized gas valve arrangement 50, which also includes the connection 64 with the throttle mechanism 63, is a container relief mechanism 73 that serves for the final reduction of the pressure of the filled container to atmospheric pressure. The container relief means 73 includes a relief channel 75 that is provided with a throttle member 74. The relief channel 75 leads from that face of the base plate 58 that faces the valve member 52, and is guided downwardly in the base plate 58 to open out at the outer peripheral surface thereof into the atmosphere. A non-illustrated channel that is provided in the valve member 52 connects, in the relief position of the valve member 52, the equalizing channel 60, the pressurizing gas introduction channel 62, and the relief channel 75.

Figure 5:
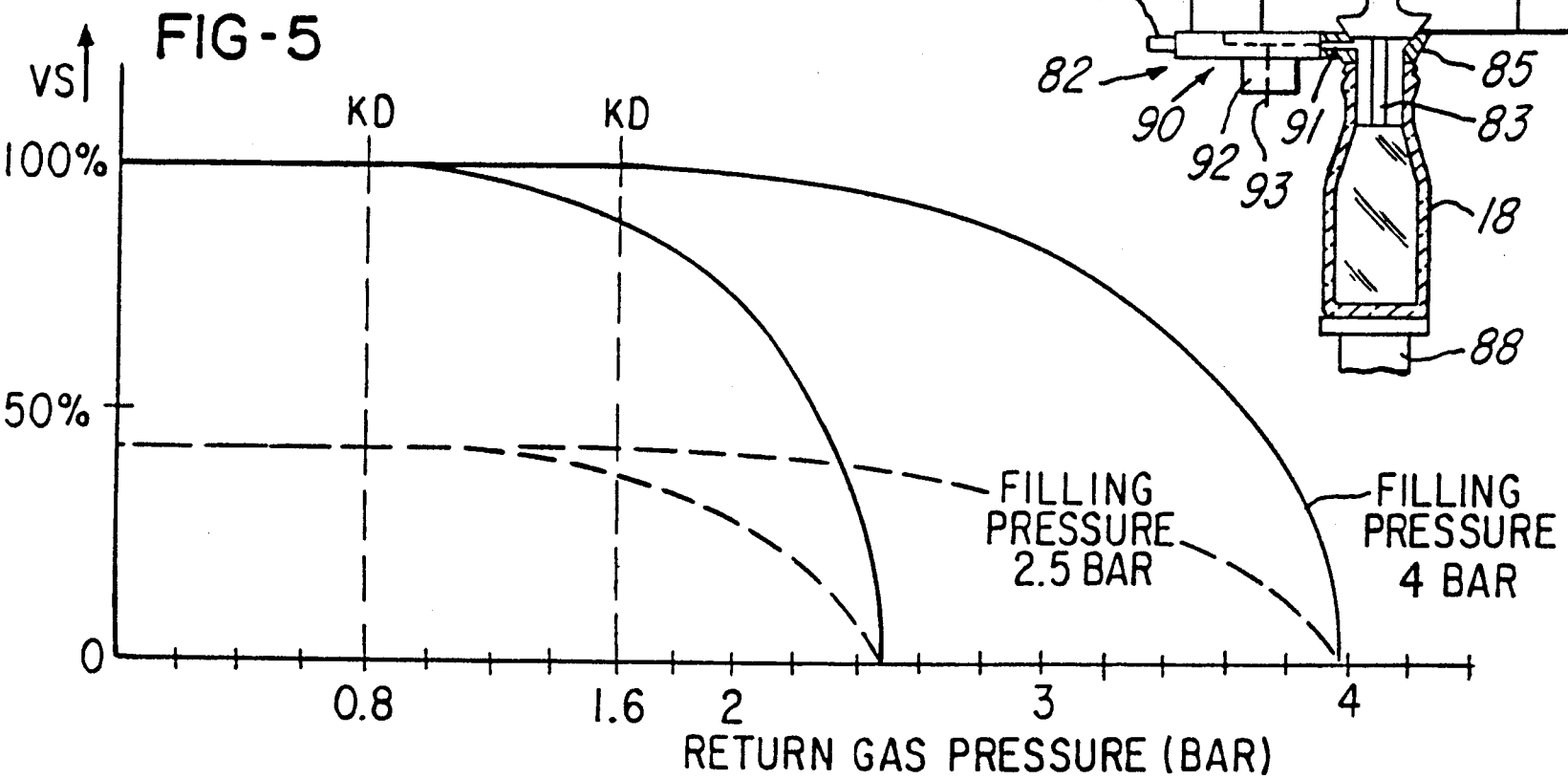
FIG. 5 is a view showing a graph in which, for the counterpressure filling machine of FIGS. 1 to 4, the volume stream of the return gas that flows into the return gas chamber via the throttle mechanism is plotted as a function of the return gas in the return gas chamber at two different filling pressures.

The graph illustrated in FIG. 5 shows the effect of the throttle mechanism 63 upon the flow rate or volume stream VS (volume per unit of time) of the return gas, which in the filling phase, i.e. during filling of a container 18, is displaced by the liquid flowing into the container 18 and is conveyed via the throttle mechanism 63 into the return gas chamber 26, and hence also shows the effect of the throttle mechanism 63 upon the filling speed (quantity of liquid supplied to the respective container 18 per unit of time), with these effects being standardized as a function of the return gas pressure in the return gas chamber 26, and in particular with the solid line curves showing filling at a high speed, i.e. a return gas stream through both Venturi tubes 65 and 67, and with dashed-line curves where the return gas stream is effected through only the Venturi tube 65 for a reduced filling speed. The volume stream VS for a return gas stream through both Venturi tubes 65 and 67, and a very low return gas pressure in the return gas chamber 26, is assumed to be 100%. The progress of the volume stream VS as a function of the return gas pressure in the return gas chamber 26 is plotted in FIG. 5 for two different filling pressures of 2.5 bar and 4 bar in the liquid chamber 11, i e. in the liquid line 28. As shown in FIG. 5, at a return gas pressure in the return gas chamber 26 that is below a critical pressure KD, the volume stream VS is determined independently of this return gas pressure and exclusively by the throttle mechanism 63, i.e. by the effective cross section of the Venturi tubes 65 and 67. In the illustrated embodiment, at a filling pressure of 2.5 bar the critical pressure KD is approximately 0.8 bar, and at a filling pressure of 4 bar the critical pressure KD is approximately 1.6 bar. If the return gas pressure in the return gas chamber 26 is greater than the respective critical pressure KD that is a function of the filling pressure, i.e. if the return gas pressure in the return gas chamber 26 is between the filling pressure and the critical pressure KD of the throttle mechanism 63, the volume stream VS, and hence also the filling speed at a prescribed construction of the throttle mechanism 63 (especially the effective cross section of the Venturi tubes 65 and 67), are a function of the return gas pressure set or regulated in the return gas chamber 26 with the aid of the pressure sensor 33 and the regulating valve 32. In this case, in this manner of operating the filling machine 10, the respective filling speed can be optimally adapted to the filling characteristics of the liquid that is to be dispensed by setting the return gas pressure in the return gas chamber 26. This can be accomplished without altering the throttle mechanism 63, and in particular could also be accomplished in such a way that during the filling, no excessive quantities of carbon dioxide are released and hence no undesired foaming of the liquid in the container 18 occurs.

Independently hereof, however, with the described embodiment the return gas pressure in the return gas chamber 26 is set or regulated with the aid of the pressure sensor 33 and the regulating valve 32 to a value that in a pre-relief phase of the respective container lB, which phase follows the filling phase, and with the liquid flow valve 48 already being closed again, forms a pre-relief pressure that is selected to be between the atmospheric pressure and the saturation pressure of the carbonated liquid that is to be dispensed in such a way that at this pre-relief pressure, the liquid dispensed into the pertaining container 18 can become calm during the pre-relief phase and a rising of carbon dioxide from the filled liquid is still just possible, without a foaming up or over of the liquid occurring, and without liquid passing to the outside or into the return gas chamber 26 or the connection 64 during this pre-relief.

To the extent that the liquid that is to be filled permits it (especially its ability to retain carbon dioxide, the carbon dioxide fraction present in the liquid, the filling temperature, as well as the filling and saturation pressures that ar also dependent thereon), the return gas pressure in the return gas chamber 26 is preferably set such that it not only assures an optimum pre-relief of the respectively filled container 18, but also lies between the critical pressure KD and the respective filling pressure in such a way that due to the return gas pressure in the return gas chamber 26 during the filling phase a filling speed is achieved that is as optimally as possible adapted to the properties of the respective liquid that is to be dispensed.

When champagne is bottled with 9.5 g $CO_2$/liter and a temperature of 15° C., the return gas pressure in the return gas chamber 26 can be set to a value of 0.8 bar at a filling pressure of 6.5 bar and a $CO_2$ saturation pressure of 3.0 bar, so that after the filling phase a pre-relief of the container 18 for the bottle is already possible at a pre-relief pressure of 0.8 bar, and in particular without foam being formed or the liquid (champagne) that is to be bottled escaping to the outside or passing into the return gas chambers 26 or into the connection 64.

After setting the filling machine to the required filling pressure, the pressurizing gas pressure, as well the return gas pressure that is required for the pre-relief, the actual filling during rotation of the machine is started. In so doing, as shown in FIG. 2, each of the containers 18 that is to be filled, namely a bottle in the illustrated embodiment, is brought via the interposition of a sealing element 78 of the centering member 14 into a sealing position with the bottom end of the filling element housing 40 of the filling element 12, and the customary pressurizing with air or an inert gas, which pressurizing can in certain cases be preceded by a preliminary rinsing, is subsequently effected, upon release of the liquid flow valve 48 by a control signal that is delivered to the actuating device 46 from the control mechanism 47 via the signal line "a", so that by means of the effect of the opening spring 42, the liquid flow valve 48 is brought into the open position shown in FIG. 2. At this point in time, for filling at a reduced filling speed, the valve member 52, after the operating lever 54 has run onto a control element 56, assumes a position in which the channel section 69 is continuously free via the control recess 72, so that during the liquid introduction that now begins, the return gas that is displaced by the liquid that exits the lower end of the filling tube 13, and that, for example, is a gas mixture comprising pressurizing gas and the air that was in the container 18 that is to be filled, enters the delivery channel section 68 via the opening of the container and the sealing element 78, and is subsequently withdrawn into the return gas chamber 26, which is at the set return gas pressure, via the channel section 69 and the Venturi tube 65 disposed therein, as well as via the withdrawing channel section 71 of the connection 64. In so doing, regardless of the cross section of the Venturi tube 65 and the return gas pressure that is regulated in the return gas chamber 26, a pressure gradient is established in the container 18 that is to be filled relative to the filling pressure, whereby the liquid slowly exits at a low flow rate out of the bottom end of the filling tube 13. If during continuing rotation of the filling element 12 the liquid that is rising in the container 18 reaches the bottom end of the filling tube 13, the discharge valve 66 is opened due to a control signal that is delivered via the control line "b" from the control mechanism 47, as a result of which the return gas can now additionally also be withdrawn via the further Venturi tube 67. In so doing, a pressure gradient is established in the container 18 relative to the filling pressure, with this pressure gradient being a function of at least the effective cross section of the Venturi tubes 65 and 67 and, where the return gas pressure in the return gas chamber 26 lies between the critical pressure KD and the filling pressure, also of this return gas pressure; the further introduction of liquid continues at an increased flow and filling rate. This filling at a greater rate is concluded when the liquid begins to rise in the narrowing portion of the container 8 by closing the discharge valve 66 due to a control signal that is given off to the discharge valve 66 via the control line "b" from the control mechanism 47.

During continuing rotation of the filling element 12, with now only the Venturi tube 65 being effective, the liquid introduction continues at a reduced flow or filling rate, and in particular until at a predetermined rising height the switching element 49 is actuated, whereupon the control mechanism 47 emits a control signal that via the control line "a" activates the actuating device 46 and, for closing the liquid flow valve 48, presses the valve body 43 onto the valve seat 41 against the effect of the opening spring 42. At this point the filling phase is concluded.

Subsequently, with the filling element 12 continuing to rotate, for a predetermined period of time the bottled liquid is calmed during the pre-relief phase, and in particular due to the fact that the return gas pressure regulated or set in the return gas chamber 26 becomes effective in the filled container via the channel section 69 of the connection 64 that is still effective or open from the filling phase, so that carbon dioxide bubbles that have formed in the dispensed liquid can rise without thereby causing a foaming up or over of the liquid. Only after the conclusion of the pre-relief phase, and during continuing rotation of the filling element 12, does the operating lever 54 run against a control element 56. During the thereby effected pivoting of the valve member 52, the channel section 69 is first interrupted by removal of the control recess 72 from operative connection with the channel section 69. Shortly thereafter, in order to undertake the final relief of the pressure of the container to atmospheric pressure, the valve member 72 assumes an operating position in which the non-illustrated channel connects the pressurizing gas introduction channel 62 and the equalizing channel 60 with the relief channel 75, so that via the latter and the throttle member 74 disposed therein, the pre-relief pressure that is still present in the filled container 18 is then relieved to atmospheric pressure. In so doing, the mutual equalization of the liquid levels in the interior of the filling tube 13 and in the container 18 also takes place. During continuing rotation of the filling element 12, the relieved container 18 is removed from the filling element 12 by being lowered via the lifting cylinder 16, and is withdrawn from the machine in the region of the container discharge thereof.

If during the previously described operation a different filling condition of the liquid that is to be bottled is observed, because, for example, the temperature and/or the $CO_2$ content of the liquid that is to be bottled has a different value, or the type of bottle is changed, and therefore foaming of the liquid occurs during the pre-relief phase, then, via a change of the previous pressure setting that is to be undertaken at the pressure sensor 33, the return gas pressure that is to be regulated is adapted to the changed filling conditions in order to achieve an optimum pre-relief that is also adapted to this filling condition, and in particular possibly again with simultaneous optimization of the flow or filling rate via the set return gas pressure, to the extent that the liquid that is to be bottled makes this possible.

The procedure is similar if, due to a change of type, a liquid that is to be bottled is supplied to the filling machine 10 that in contrast to the previously bottled liquid has a different filling condition, so that a pre-relief that is effective as possible, and hence also a capacity for the filling machine 10 that is as optimum as possible (number of filled containers or bottles per unit of time), can be achieved. In so doing, care must be taken that the return gas pressure, and hence also the pre-relief pressure, that are to be regulated are as far as possible below the saturation pressure of the respective liquid that is to be processed, yet are sufficiently over the atmospheric pressure, so that although a calming of the bottled liquid can occur in the previously described manner, this liquid does not foam up or over in the pre-relief phase, and accordingly the final relief to atmospheric pressure can then also be effected in a relatively short time and without a foaming up or over of the liquid. Since each filling element 12 of the filling machine 10 is connected to the return gas chamber 26, which is common to all of the filling elements 12, via its connection 64, which is provided with the throttle mechanism 63, each change of the pressure setting undertaken at the pressure sensor 33 simultaneously acts upon all of the filling elements 12, so that the pre-relief pressure that is optimum for the pre-relief phase can be established in common for all of the filling elements 12, and it is similarly possible via a common adjustment for all of the filling elements 12, to adapt the return gas pressure in the return gas chamber 26 for a flow or filling rate that is optimally adapted to the filling condition of the liquid that is to be bottled, to the extent that for this purpose, at predetermined properties of the liquid that is to be bottled, and taking into consideration the pre-relief pressure required for the pressurizing phase, the return gas pressure in the return gas chamber 26 can be set to a value between the critical pressure KD of the throttle mechanism 63 and the filling pressure.

Pursuant to a further specific embodiment of the present invention, it is also proposed to use at least a portion of the return gas that is withdrawn into the return gas chamber 26 via the connection 64 for pressurizing the container and/or for a preliminary rinsing that precedes pressurizing of the container. This is of economical importance especially if the liquid introduction (filling phase) is accelerated or to a large extent is to be effected under the exclusion of air and at low $CO_2$ consumption. However, this presumes that inert gas, for example $CO_2$, is used not only for the pressurizing but also for a possible preliminary rinsing that precedes the pressurizing. In such a case, it is advisable, for the reuse of the return gas, to provide in each filling element 12 a conduit that leads from the connection 64, that then downstream of the Venturi tube 65 i s connected to the channel 69, and that opens out on that face of the base plate 58 that faces the valve member 52. In addition, the valve member 52 is to be provided with a connecting channel, so that in an operating position that precedes the actual pressurizing position, and that is intended for preliminary rinsing and/or partial pressurizing, the equalizing channel 60 can be connected with the withdrawal conduit. In this preceding operating position for the valve member 52, the rinsing is effected before the container 18 is brought into a sealing position with the filling element 12, and the partial pressurizing to the pressure that is to be regulated is effected after the container 18 is brought into a sealing position with the filling element 12, whereupon only upon continuing rotation of the filling element 12 is the actual pressurizing in the operating position of the valve member 52 provided therefore carried out. When the operating position for preliminary rinsing and partial pressurizing has been assumed, the return gas that is under the pressure that is to be regulated passes out of the return gas chamber 26 via the non-illustrated delivery conduit and the similarly not-illustrated connecting channel into the equalizing channel 60 and from there via the equalizing chamber 61 and the interior of the filling tube 13 into the container 18. In the container 18, the return gas then flows upwardly, thereby displacing to the outside the air that was in the container lB through the mouth of the not yet sealed off container, with this taking place until the container 18, during continuing rotation of the filling element 12 and the thereby effected upward stroke of the lifting cylinder 16, is brought by the latter into the sealing position shown in FIG. 2. Once the sealing position has been assumed, the partial pressurizing of the container to the pressure that is to be regulated is initiated. If in so doing the danger exists that for rinsing and partial pressurizing so much return gas is removed from the return gas chamber 26 that the prerelief pressure required for the pre-relief phase cannot be maintained via the return gas that is to be supplied to the return gas chamber 26, then in order to maintain this prerelief pressure, a sufficient quantity of pressurizing gas is to be supplied to the return gas chamber 26, for example via a non-illustrated connector line that would then connect the return gas chamber 26, or the extending line 31, with the annular distribution chamber 25 or the pressurizing gas line 29, and that is controlled by the pressure sensor 33 and can also be used to supply the return gas chamber 26 with the return gas pressure that is to be regulated during establishment of the operational readiness of the filling machine 10.

Figure 4:
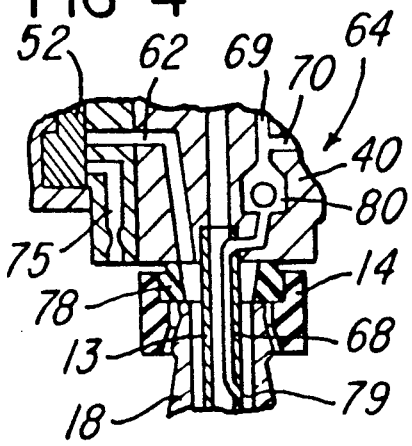

The preceding embodiments apply not only to the described filling machine 10, which is provided with filling elements 12 each having a controlled liquid flow valve 48 that is brought to the closed position as a result of a signal emitted by the switching element 49 when the liquid in the container 18 rises to a predetermined height. Without deviating from the inventive concept, the respective liquid flow valve 48 could also be closed by a signal that is emitted by the control mechanism 47 after a specific quantity of liquid has actually been introduced into the container 18. The liquid flow valve could also be mechanically brought to the closed position in a conventional manner after further rise of the liquid in the container is interrupted via an input that determines the filling height. In the latter case, as shown in FIG. 4, in place of the switching element 49 the input 79 of the connection 64 is placed in a customary manner in the container 18 that is to be filled for the purpose of determining the filling height. A ball retaining check valve 80 is associated with and above the input 79 in a known manner in the delivery channel section 68 for the purpose of interrupting the supply of liquid to the container 18. With this embodiment it could also be expedient to mechanically control the discharge valve 66 and to transfer the function thereof to the valve member 52.

Figure 6:
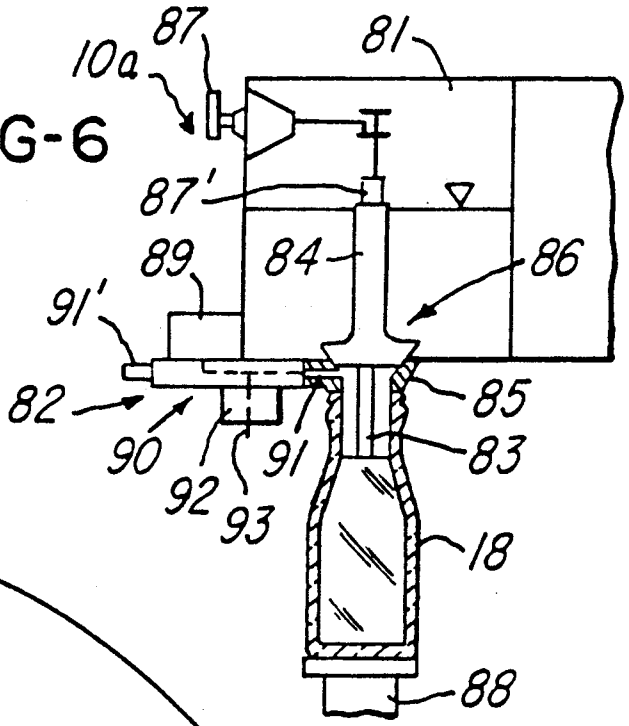
FIG. 6 is a simplified diagrammatic view of a single-chamber counterpressure filling machine, together with one of the controlled filling elements of the filling machine.

FIG. 6 diagrammatically illustrates a rotating, single-chamber counterpressure filling machine **10*a*. This filling machine 10*a*, which is similarly intended for dispensing carbonated liquids, is provided with an annular liquid chamber 81, on the underside of which are provided a plurality of filling elements 82 that are uniformly spaced from one another and that each have a valve body 84 provided with a return gas tube 83, and a filler element 85 that forms the dispensing channel. The filler element 85 is, on that inner face thereof that delimits the dispensing channel, embodied as a valve seat that together with the valve body 84 forms the liquid flow valve 86 and against which the valve body 84 can be brought to rest in order to close the liquid flow valve 86. To open and close the liquid flow valve 86, the valve body 84, with the gas valve 87', is operated via a control lever 87 that cooperates with cams, especially sequence switch cams, on a nonillustrated fixed control ring of the filling machine 10*a***.

Associated with each filling element 82 is a raising and lowering mechanism, of which only the associated support plate 88 is shown in FIG. 6. The filling machine **10*a* is furthermore provided with an annular chamber 89 that is common to all of the filling elements 82 and is disposed on the outer periphery of the liquid chamber 81. The chamber 89 is provided with an adjustable or regulatable pressure that corresponds to the pre-relief pressure required in the pre-relief phase. The adjustment or regulation of this pressure in the chamber 89 is, for example, effected via a pressure sensor that corresponds to the pressure sensor 33 of the filling machine 10 and with which is associated a regulating valve that corresponds to the regulating valve 32 and is disposed in an outlet of the chamber 89 that leads to the atmosphere. Provided below the chamber 89, and partially also below the liquid chamber 81, is a control valve arrangement 90 that via an actuating element 91' cooperates with cams, such as sequence switch cams, of a non-illustrated fixed control ring of the filling machine 10***a*, or is controlled in any other suitable manner, for example electrically or electro-pneumatically. At least in the closed position of the liquid flow valve 86 the inlet of the control valve arrangement 90 communicates via a connecting channel 91 with the dispensing channel downstream of the liquid flow valve 86 An outlet of the control valve arrangement 90 of each filling element 82 is connected to the chamber 89. A further outlet of the control valve arrangement 90 is connected with a container relief means 92 that corresponds to the container relief means 73 and is provided with a relief channel 93 that has a pertaining throttle element and is open to the atmosphere.

The control valve arrangement 90 has three operating positions, namely a first operating position in which there is no connection between the inlet and the outlets of the control valve arrangement 90, a second operating position in which the inlet as well as the first outlet of the control valve arrangement 90 are interconnected and thus a flow medium connection exists between the connecting channel 91 and the chamber 89, and a third operating position in which the inlet as well as the second outlet of the control valve arrangement 90 are interconnected and thus a flow medium connection exists between the connecting channel 91 and the container relief means 92 or the relief channel 93 thereof.

To fill the container 18, the latter is pressed via the raising and lowering mechanism, i.e. via the support plate 88, from below against the filling element 82, so that the mouth of the container 18, accompanied by the interposition of a non-illustrated sealing element, rests tightly against the filler element 85. To initiate the filling phase, the gas valve 87' is opened by raising the control lever 87 into the position illustrated in FIG. 6, whereby the liquid flow valve 86 is released, so that with an established pressure equalization between the container 18 and the liquid chamber 81 the liquid flow valve 86 opens and the liquid can flow to the container 18. Filling of the container 18 is concluded as soon as the liquid that is rising in the container 18 reaches the bottom end of the return gas tube 83. The liquid flow valve is then closed, thereby conclusively terminating the filling phase. The control valve arrangement 90, which up to now was in the first operating position, is then brought into the second operating position for the subsequent pre-relief of the filled container 18 as a result of which the pressure in the filler container 18 can be relieved via the connecting channel 91 to the pre-relief pressure that exists or is regulated in the chamber 89. With this embodiment also, the pre-relief pressure is again set in such a way that undissolved carbon dioxide, i.e. carbon dioxide bubbles that might be present, can rise from the dispensed liquid, yet a foaming up or over of the liquid, or an escape of this liquid from the container 18, does not occur during the subsequent relief of the pressure to atmospheric pressure. Only after this pre-relief phase to the pre-relief pressure, which exists in the chamber 89, is greater than atmospheric pressure, and is maintained for a certain amount of time to calm the dispensed liquid, is the control valve arrangement 90 brought into its third operating position, in which, via the container relief means 92 that is connected with the connecting channel 91, the container 18 is relieved from the pre-relief pressure to atmospheric pressure. During continuing rotation of the filling element 82, the relieved container 18 is removed from the filling element 82 by being lowered via the support plate 88 or the raising and lowering mechanism, and can in this state then be removed in the region of the container discharge of the filling machine 10*a*.

Figure 7:
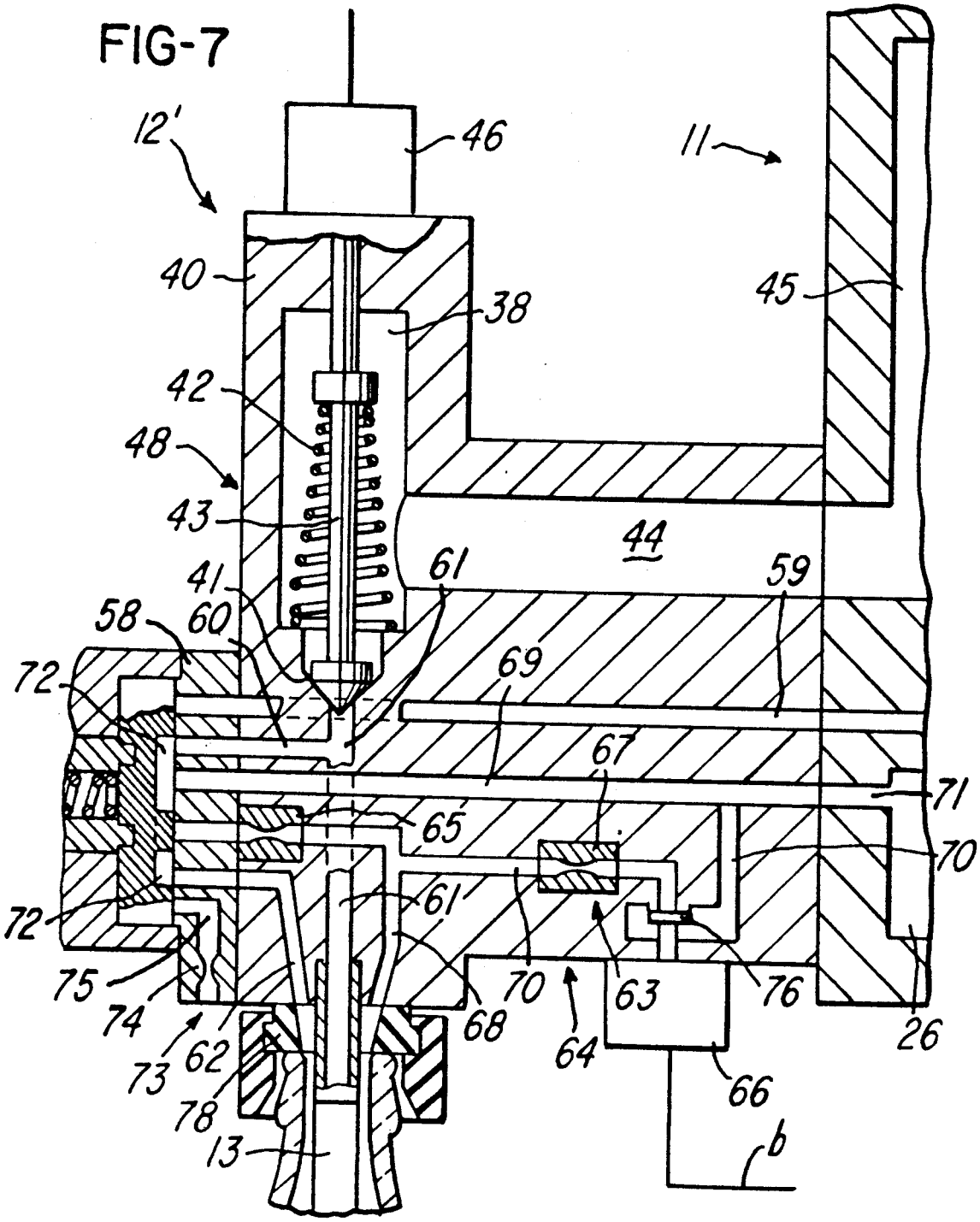
FIGS. 7 and 8 are enlarged detailed views similar to FIG. 2 of a modified embodiment of a filling element of the counterpressure filling machine of FIG. 1, and in particular show two different operating positions of a pressurized gas valve arrangement.
Figure 8:
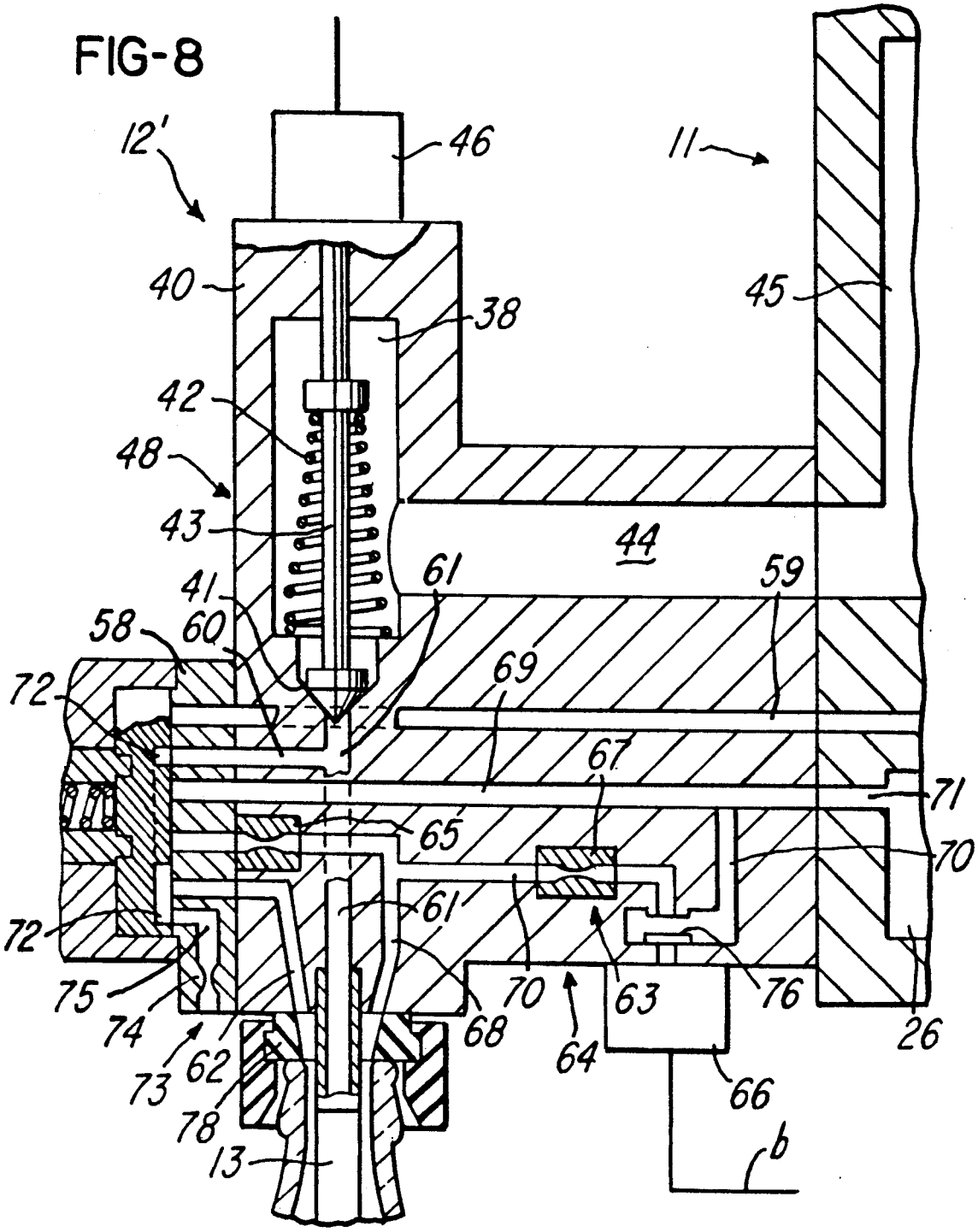

In a manner similar to FIG. 2, although in a larger scale, FIGS. 7 and 8 show a filling element 12' that together with further, identical filling elements 12' can be used in place of the filling element 12 with the three-chamber counterpressure filling machine 10. The filling element 12' differs from the filling element 12 merely in that the Venturi tube 65 of the throttle mechanism 63 is placed in the channel section 68 rather than in the channel section 69, and in particular in that portion of the channel section 69 that is disposed between the branch to the channel section 70 and the valve member 52.

With this preferred embodiment of the present invention, control of the three-chamber counterpressure filling machine 10, i.e. the filling elements 12' thereof, which have the similarly long filling tube 13, is effected in such a way that after termination of the filling phase, in other words after the liquid flow valve 48 has been closed, a pre-relief of the respectively filled container 18 is effected to the return gas pressure set in the return gas chamber 26, and in particular again via the channel section 68 with the Venturi tube 65 and the channel section 69. However, with this embodiment of the invention, approximately upon reaching the return gas or pre-relief pressure, and hence during the pre-relief or calming phase, an equalization of the liquid levels within the filling tube 13 and in the container 18 are effected at pre-relief pressure. For this purpose, after closing the liquid flow valve 48 by appropriate changeover of the pressurized gas valve arrangement 50, which changeover is again effected via a control element 56 that cooperates with the operating lever 54, the valve member 52 is moved into an operating position (FIG. 7) in which, via the control recess 72 provided in the valve member 52, a connection is established between the equalizing channel 60, the pressurizing gas channel 62, and the channel section 69. As a result of this connection, the equalization of the liquid levels is then possible at the pre-relief pressure in the pre-relief phase, whereby in particular carbon dioxide that has possibly been released in the filling tube 13 can then also flow out of this filling tube into the return gas chamber 26 via the equalizing channel 60.

Also with this embodiment there is then effected after conclusion of the calming or pre-relief phase the final relief of the pressure of the respective container to atmospheric pressure. For this purpose, the valve member 52 of the pressurized gas valve arrangement 50 is brought into an operating position in which, via the single control recess 72 for all operating positions, the pressurizing gas introduction channel 62 and the equalizing channel 60 are connected with the relief channel 75, yet a connection between the channel sections 68 and 69 is interrupted.

The above described equalization of the liquid levels during the calming or pre-relief phase, approximately upon reaching the pre-relief pressure, has considerable advantages. Since during the pre-relief carbon dioxide that may have been released in the filling tube can flow into the return gas chamber 26 via the equalizing channel 60 and the channel section 69, which is not provided with the Venturi tube 65, a possible gas cushion in the filling tube 13, and an associated gas surge out of the filling tube, are avoided during the pre-relief. Such a gas surge, which would occur in particular during the relief to atmospheric pressure, would lead to a considerable unsettling of the liquid, especially also in the container 18, and hence to an additional release of carbon dioxide with considerable formation of foam. The equalization of the liquid levels approximately upon reaching the pre-relief pressure also contributes considerably to an improved condition of the dispensed liquid in the relief phase.

Since with this embodiment of the invention the equalization of the liquid levels has already taken place before the final relief of the pressure of the respective container 18 to atmospheric pressure, it is also possible to begin withdrawal of the filled container from the pertaining filling element 12' upon initiation of the final relief of the pressure of the container to atmospheric pressure, or immediately thereafter. In particular, this can be accomplished along with careful emptying of the filling tube 13 while avoiding any unsettling of the liquid, which unsetting could lead to unnecessary release of carbon dioxide and to a formation of foam in the container 18. Since in particular an unnecessary formation of foam in the filling tube 13 or in other channels of the respective filling element 12' is also prevented, little drop loss results with this embodiment, and hence a cleaner manner of operation for the counterpressure filling machine 10 results.

The previously described equalization of the liquid levels at pre-relief pressure can in principle be utilized, with the aforementioned advantages, for all counterpressure filling machines having a long filling tube.

Pursuant to a further specific embodiment of the present invention, the control of, for example, the three-chamber counterpressure filling machine 10, which, for example, is again provided with the filling elements 12', is effected in such a way that after the pre-relief or calming phase, the relief is first undertaken to a slight overpressure or relief pressure of approximately 0.1–0.6 bar. Then, when this slight overpressure of, for example 0.5 bar is reached, the appropriate container 18 is withdrawn from the pertaining filling element 12', so that the relief to atmospheric pressure is then effected via the mouth of the container. In order to achieve relief to the slight overpressure or positive pressure, the valve member 52, after conclusion of the pre-relief phase, is brought into an operating position (FIG. 8) in which, with the channel sections 68 and 69 being interrupted, the equalizing channel 60, the pressurizing gas introduction channel 62 and the relief channel 75 are interconnected via the control recess 72. In addition, the discharge valve 66 is opened. Taking into consideration the return gas pressure in the return gas chamber 26, the respective diameters of the Venturi tube 67 and the throttle member 74 are selected in such a way that the desired slight positive pressure or relief pressure is set in the container 18. The advantage of this method is a particularly careful treatment, especially also of such liquids or beverages that tend to release a lot of carbon dioxide and are susceptible to increased foaming. The relief to a slight positive pressure can, in principle, be utilized with all counterpressure filling machines, whether or not they have a filling tube, and in particular especially with the advantage that dislodged or released carbon dioxide and air bubbles can be carefully withdrawn to the atmosphere.

The above described embodiment proceeds from the use of the return gas pressure in the return gas chamber 26 to generate the slight over pressure or positive pressure. In principle, it is also possible for this purpose to provide a separate or additional chamber that is provided with a pressure medium. This embodiment has the advantage that the pre-relief pressure in the return gas chamber 26 can be varied without thereby altering the slight positive pressure or relief pressure.

It should be noted that with the inventive method not only can the filling capacity or efficiency be increased, but also the absorption of oxygen during the filling process can be reduced, because not only can the filling pressure be reduced, but also the possibility is provided that during the pre-relief after the filling process, air bubbles that are present in the dispensed beverage can rise under the pre-relief pressure. This is of particular advantage during the bottling of beer.

The present invention is, of course, in no way restricted to the specific disclosure of the specification and drawings, but also encompasses any modifications within the scope of the appended claims.

What I claim is:

1. In a method of dispensing a carbonated liquid, especially a beverage, into a container, such as a bottle, under counterpressure, whereby the introduction of said liquid, which is under a filling pressure, into said container, which is in a sealing position with a filling element, is effected during a filling phase that follows pressurizing of said container, whereby return gas displaced by incoming liquid is withdrawn from said container, at least for a while, via a return gas passage of said filling element, and whereby after termination of said filling phase, with said container still in a sealing position with said filling element, first a pre-relief of pressure in said container to a pre-relief pressure is effected in a prerelief phase, and subsequently a predetermined relieving of pressure in said container to atmospheric pressure is effected, comprising the improvement steps wherein:

regulating of said pre-relief pressure occurs in such a way for variable adjusting in a stepless manner to a pressure that is between atmospheric pressure and the saturation pressure of said liquid, that during said pre-relief phase it is still just possible for released carbon dioxide to rise in the dispensed liquid without there occurring during said relieving to atmospheric pressure an undesired escaping of liquid from a filled container as a result of disadvantageous foaming of said liquid, said regulating of the relief pressure for said variable adjusting to a stepless manner to the pressure that is between atmospheric pressure and the saturation pressure of said liquid thus effecting greatly increased efficiency and output during dispersion of carbonated liquid.

2. A method according to claim 1, in which, at least during said pre-relief phase, said filled container communicates with a chamber in which said pre-relief pressure is regulated.

3. A method according to claim 2, in which after said filling phase said filled container communicates with said chamber via a control valve arrangement.

4. A method according to claim 2, in which, during said filling phase, said displaced return gas is withdrawn with a pressure gradient into said chamber, which is at said regulated pre-relief pressure, via a connection that forms said return gas passage and is provided with throttle means.

5. A method according to claim 4, in which said pressure that is regulated in said chamber lies between the filling pressure and a critical pressure of said throttle means.

6. A method according to claim 4, which includes the step of utilizing at least a portion of said return gas that is displaced into said chamber via said connection for pressurizing said container and/or for a preliminary rinsing of said container that precedes said pressurizing.

7. A method according to claim 2, in which said pressure that is regulated in said chamber is less than the saturation pressure of said liquid that is to be dispensed.

8. A method according to claim 2, in which said pressure that is regulated in said chamber is at least close to the saturation pressure of said liquid that is to be dispensed.

9. A method according to claim 2, which includes the step of regulating said pressure in said chamber as a function of the filling pressure of said liquid that is to be dispensed.

10. A method according to claim 1, which includes the step of effecting equalization of the liquid levels in said container and in a filling tube of said filling element during said pre-relief phase, preferably when said pre-relief pressure has been reached in said container.

11. A method according to claim 1, which includes the additional step, after pre-relief but prior to final relief of the pressure of said container to atmospheric pressure, of effecting a relief to a slight positive pressure that can be set approximately between 0.1 and 0.6 bar.

12. A method according to claim 11, which includes the steps of removing said container from said filling element when said slight positive pressure is reached, and effecting said final relief to atmospheric pressure via the mouth of said container.

13. A method according to claim 11, in which said container is in communication with the atmosphere during relief to said positive pressure via at least one Venturi tube or at least one throttle element.

14. A method according to claim 1 which includes the step of utilizing more than one filling element in a circulating operation with the dispensing of the carbonated liquid via multiple filling elements.

15. In an apparatus for dispensing a carbonated liquid, especially a beverage, into a container, such as a bottle, under counterpressure, with said apparatus including: a liquid chamber for the liquid that is to be dispensed; at least one filling element, with which a respective container that is to be filled is brought into a sealing position at least during pressurizing of said container, a filling phase, and first a prerelief of the pressure of a filled container to a pre-relief pressure and subsequently a relief of the pressure of said filled container to atmospheric pressure; a filling channel that is provided on said filling element and that is adapted to communicate with said liquid chamber via a controlled liquid flow valve; a return gas passage formed on said filling element for return gas that is displaced from said container during said filling phase and/or that flows off during relief of said container; and a further chamber that includes outlet means to the atmosphere and that communicates with said return gas passage at least during said pre-relief phase, which follows said filling phase, the improvement comprising:

a regulating valve that is connected to said outlet means of said further chamber, with said regulating valve being adapted to be opened when the pressure in said further chamber exceeds the pre-relief pressure, which is to be regulated variably in a stepless manner to a pressure that is between atmospheric pressure and the saturation pressure of said liquid.

16. An apparatus according to claim 14, which includes a first pressure sensor that is operatively associated with said regulating valve, is disposed in said further chamber respectively said outlet means thereof to sense the pressure therein, and is adapted to move said regulating valve into an open position when the pressure in said further chamber exceeds said pre-relief pressure that is to be regulated.

17. An apparatus according to claim 15, which includes a line for supplying said liquid that is to be dispensed to said liquid chamber, and which includes a further pressure sensor that is disposed in said liquid line and is operatively associated with said first pressure sensor in such a way that said regulating valve is brought into an open position when the pressure differential between the pressure sensed by said first pressure sensor and the pressure sensed by said further pressure sensor exceeds a predetermined value.

18. An apparatus according to claim 14, in which said filling element is provided with a long filling tube and a controlled pressurized gas valve arrangement, and is connected to a pressurizing chamber for pressurizing gas; and in which said further chamber is a return gas chamber that is connected to said return gas passage, which is formed by a connection that is provided with a throttle mechanism and that is adapted to be closed off by said pressurized gas valve arrangement.

19. An apparatus according to claim 17, in which said connection comprises a first channel section, which is provided with a discharge valve that is adapted to be moved into an open position for filling of said container at a high filling rate, and a second channel section for filling at a reduced filling rate, with said second channel section being provided with a shutoff valve; and in which said throttle mechanism includes a first Venturi tube, which acts as a throttle element and is disposed in said first channel section, and a second Venturi tube, which is disposed in said second channel section.

20. An apparatus according to claim 18, in which said shutoff valve is in the form of a flat slide-type valve that is provided with a valve member which is designed for several operating positions, such as pressurizing, filling and subsequent pre-relief, and relief to atmospheric pressure, whereby during operation of said apparatus, said valve member is adapted to be moved into said operating positions via control elements.

21. An apparatus according to claim 17, which includes an electrically controlled liquid flow valve, and a signal emitter, in the form of an electrical switching element disposed on an outer surface of said filling tube, for emitting a signal to close said liquid flow valve when a threshold filling height is reached in a container.

22. An apparatus according to claim 17, which includes an equalizing channel that is formed in said filling element and communicates with said filling tube; and in which connected to said return gas chamber or said closeable connection, downstream of said throttle mechanism thereof, is a closeable channel that serves for the withdrawal of return gas and that, for preliminary rinsing and/or pressurizing of a container that is to be filled with return gas, is adapted to be connected to said equalizing channel.

23. An apparatus according to claim 14, in which said filling element is provided with a filling tube, and in which a control valve arrangement is provided that, for equalization of liquid levels within said filling tube and in said container, is adapted to be disposed at said prerelief pressure into an operating position in which the interior of said filling tube is connected not only with that space of said container above the liquid level thereof, but also with a channel that in turn is connected with said further chamber, which is in the form of a return gas chamber and is provided with said outlet means to the atmosphere, whereby said channel that leads to said return gas chamber is preferably a channel section of said return gas passage and has no throttle mechanism therein.

24. An apparatus according to claim 14, in which said filling element is provided with a filling tube and a relief channel that is open to the atmosphere via at least one throttle member, with said relief channel, for relief of said container, being connected to the space of said container above the liquid level thereof, relative to the interior of said filling tube, and to a closeable channel section that is provided with a Venturi tube and leads to said further chamber, which is a return gas chamber; said throttle member and said Venturi tube are selected such that with said channel section in an open state, a relief pressure that is slightly greater than atmospheric pressure results, with said relief pressure preferably being between 0.1 and 0.6 bar, and with said channel section preferably being part of a throttle mechanism of said return gas passage.

* * * * *